US009708108B2

(12) United States Patent
Gregory et al.

(10) Patent No.: US 9,708,108 B2
(45) Date of Patent: Jul. 18, 2017

(54) PORTABLE BEVERAGE CONTAINER AND LID ASSEMBLY

(71) Applicant: RUBBERMAID INCORPORATED, Huntersville, NC (US)

(72) Inventors: Michael Gregory, Huntersville, NC (US); Robert C Coon, Chicago, IL (US)

(73) Assignee: RUBBERMAID INCORPORATED, Huntersville, NC (US)

( * ) Notice: Subject to any disclaimer, the term of this patent is extended or adjusted under 35 U.S.C. 154(b) by 0 days.

(21) Appl. No.: 14/862,009

(22) Filed: Sep. 22, 2015

(65) Prior Publication Data

US 2017/0081092 A1 Mar. 23, 2017

(51) Int. Cl.
*B65D 47/24* (2006.01)
*A47G 19/22* (2006.01)

(52) U.S. Cl.
CPC ..... *B65D 47/249* (2013.01); *A47G 19/2272* (2013.01)

(58) Field of Classification Search
CPC ..... B65D 45/34; B65D 43/26; B65D 47/249; B65D 47/248; B65D 47/24; B65D 51/1683; B65D 51/1672; B65D 51/16; A47G 19/2272; A47G 19/2206; A47G 19/2205
USPC ..... 220/714, 715, 713, 711, 592.17, 264, 220/263, 254.5, 254.3, 254.1, 345.6, 220/345.1, 203.05, 203.04, 203.01, 202; 222/470, 472, 562, 559, 547, 545, 544
See application file for complete search history.

(56) References Cited

U.S. PATENT DOCUMENTS

| | | | | |
|---|---|---|---|---|
| 2,447,870 | A * | 8/1948 | Polcyn | A47G 19/2272 215/309 |
| 2,678,758 | A * | 5/1954 | Richmond, Sr. | B65D 45/06 222/469 |
| 6,102,244 | A | 8/2000 | Kuwano et al. | |
| 6,352,166 | B1 * | 3/2002 | Copeland | B65D 47/249 215/387 |
| 6,702,138 | B1 | 3/2004 | Bielecki et al. | |
| 8,272,532 | B2 | 9/2012 | Michaelian et al. | |
| 2002/0108959 | A1 | 8/2002 | Pollock | |
| 2005/0045634 | A1 * | 3/2005 | Ward | A47G 19/2272 220/254.3 |
| 2006/0043091 | A1 * | 3/2006 | Pinelli | A47G 19/2272 220/254.3 |
| 2010/0200602 | A1 | 8/2010 | Chan | |

(Continued)

OTHER PUBLICATIONS

Thermos Vacuum Insulated Travel Mug 360° Sip Top—www.baldmountaincoffee.com/page/BMCC/PROD/Thermos_Nissan/00002426 retrieved from the internet Sep. 25, 2015.

(Continued)

*Primary Examiner* — Robert J Hicks
(74) *Attorney, Agent, or Firm* — Marshall, Gerstein & Borun LLP

(57) ABSTRACT

A portable beverage container includes a base adapted to contain a liquid and a lid assembly that is removably coupled to the base. The lid assembly is reconfigurable between an open position, whereby a user can drink the liquid from the base at any portion along the circumference of the top of the lid assembly, and a closed position, whereby the liquid is substantially prevented from exiting the base, such that the lid assembly prevents accidental spilling or splashing.

20 Claims, 10 Drawing Sheets

(56) References Cited

U.S. PATENT DOCUMENTS

| | | | | |
|---|---|---|---|---|
| 2010/0237078 | A1 | 9/2010 | Lentz et al. | |
| 2011/0198352 | A1 | 8/2011 | Lown et al. | |
| 2013/0062304 | A1* | 3/2013 | Meyers | B65D 43/00 215/240 |
| 2014/0166654 | A1 | 6/2014 | Lane | |
| 2015/0164255 | A1* | 6/2015 | Coon | B65D 47/241 220/254.3 |

OTHER PUBLICATIONS

JOEmo 13 oz. Stainless—www.highwave.com/product-p/j1400.htm, retrieved from the internet Sep. 25, 2015.

Trudeau Executive Board Room Travel Coffee or Tea Mug, www.cappojim.com/Trudeau-Executive-Board-Room-Travel-Coffee-or-Tea-Mug-16-oz.-Black.html, retrieved from the internet Sep. 25, 2015.

Cuisipro: The Click-n-Sip is a Commuter's Must-Have Travel Mug, www.cuisipro.com/en/article/Click-n-Sip.html, retrieved from the internet Sep. 25, 2015.

Trudeau Vision 14-Ounce Stainless Steel Travel Mug, Metallic, www.amazon.com/Trudeau-Vision-14-Ounce-Stainless-Metallic/dp/B003LJX0G8, retrieved from the internet Sep. 25, 2015.

OXO Good Grips 360 LiquiSeal Travel Mug, www.espressoplanet.com/coffee-and-espresso/oxo-good-grips-360-liquiseal-travel-mug.html, retrieved from the internet Sep. 25, 2015.

Chantal Travel Mug, www.chantal.com/chantal-travel-mug.html, retrieved from the internet Sep. 25, 2015.

Cool Gear 15 oz. Monarch 360 Coffee Mug, www.sears.com/cool-gear-15-oz-monarch-360-coffee-mug/p-SPM11713653415, retrieved from the internet Sep. 25, 2015.

Toolbar Insulated Travel Mug, www.small-order.hktdc.com/small-order-suppliers-products/Insulated-Travel-Mug/en/1X00OT8D/2400546/, retrieved from the internet Sep. 25, 2015.

* cited by examiner

PORTABLE BEVERAGE CONTAINER AND LID ASSEMBLY

FIELD OF THE DISCLOSURE

The present disclosure is directed to portable beverage containers and, more particularly, to a portable beverage container having a container base and a lid assembly that, when coupled to the container base, allows a user of the container to drink from any portion along the circumference of the top of the lid assembly.

BACKGROUND

Portable beverage containers, such as tumblers, mugs, and the like, are commonly used by people who want to drink coffee, tea, or other liquids when walking, driving, or otherwise traveling between two different places. Portable beverage containers typically include a removable lid that is configured to help prevent the liquid residing in the base of the beverage container from splashing or spilling during travel. The lid is usually provided with some mechanism that permits the user to drink the liquid without removing the lid. As an example, the lid may include a valve or latch that can be opened or closed. When the valve or latch is opened, the liquid in the beverage container can flow out of the container and be consumed by the user. Conversely, when the valve or latch is closed, the lid substantially prevents the liquid from escaping the container and spilling or splashing on or around the user.

Conventionally, portable beverage container lids were designed to only permit the user to drink the liquid from a designated point, i.e., one point, on or along the circumference of the lid. As an example, many conventional beverage container lids include one small aperture that, when opened, allows the liquid to be poured out of the beverage container for consumption by the user. More recently, however, some portable beverage container lids have been developed that allow the user to drink the liquid from multiple points along the surface of the lid, for example, from any surface along the circumference of the lid. However, these portable beverage container lids, such as, for example, the lid described in U.S. Pat. No. 6,702,138, achieve this utilizing a complex, spring-driven ratchet and tooth mechanism. It will be appreciated that these complex, spring-driven mechanisms significantly add to the cost and time required to manufacture and assemble a beverage container lid.

SUMMARY

In accordance with one exemplary aspect of the present invention, a portable beverage container includes a container base and a lid assembly removably coupled to the base. The container base is adapted to store a liquid. The lid assembly includes a housing, a valve movably disposed within the housing, an actuation element pivotably coupled to a portion of the lid assembly, and a linkage element coupled to the valve. The housing defines a valve seat and a liquid passageway. The valve is movable between an open position, wherein the valve is spaced from the valve seat and the liquid can flow through the liquid passageway and out of the container base, and a closed position, wherein the valve sealingly engages the valve seat and the liquid is prevented from flowing through the liquid passageway. The actuation element is operatively coupled to the valve via a linkage element to move the valve between the open position and the closed position.

In accordance with another exemplary aspect of the present invention, a lid assembly, for use with a beverage container base adapted to store a liquid, includes a housing, a valve movably disposed within the housing, an actuation element pivotably coupled to a portion of the lid assembly, and a linkage element coupled to the valve. The housing defines a valve seat and a liquid passageway. The valve is movable between an open position, wherein the valve is spaced from the valve seat such that the liquid can flow through the liquid passageway, and a closed position, wherein the valve sealingly engages the valve seat such that the liquid is prevented from flowing through the liquid passageway. The actuation element is operatively coupled to the valve via a linkage element to move the valve between the open position and the closed position.

BRIEF DESCRIPTION OF THE DRAWINGS

The disclosure may be best understood by reference to the following description taken in conjunction with the accompanying drawings, in which like reference numerals identify like elements in the several FIGS., in which.

DETAILED DESCRIPTION

The present disclosure is directed to a lid assembly that can be removably coupled to a portable beverage container base containing a liquid (e.g., a beverage). The lid assembly is configured to prevent accidental spillage or splashing of the liquid and, at the same time, allow a user to drink the liquid from the container base at any point along the circumference of the top of the lid assembly. The lid assembly does so utilizing a toggle mechanism that does not incorporate any biasing elements (e.g., a spring) for biasing a valve and/or actuation element to a closed position and/or ratchet and tooth mechanisms for moving between closed and open positions (e.g., two gear elements having paired teeth), and, as such, is less complex than the spring-driven ratchet and tooth mechanisms known in the art, such that the lid assembly described herein is easier and cheaper to manufacture than known lid assemblies.

FIGS. 1-6 depict a first example of a portable and reusable beverage container 100 constructed in accordance with the principles of the present disclosure. The beverage container 100, which may be, for example, a mug, a tumbler, a pitcher, or the like, generally includes a container base 104 and a lid assembly 108 removably coupled to the container base 104. The container base 104 is generally configured to store or contain a liquid, which may be hot or cold, for example, coffee, milk, tea, pop (or soda), water, or any other beverage, for consumption by a user of the container 100. The lid assembly 108 is generally reconfigurable between a closed position and an open position. In the closed position, the lid assembly 108 substantially prevents any liquid contained in the container base 104 from exiting the container 100, thereby preventing the user from consuming the liquid (i.e., drinking from the container 100) but preventing the liquid contained in the container base 104 from splashing or spilling onto and/or around the user. In the open position, the lid assembly 108 allows the user to consume the liquid (i.e., drink from the container 100) from any portion along the circumference of the lid assembly 108.

Figure 1:
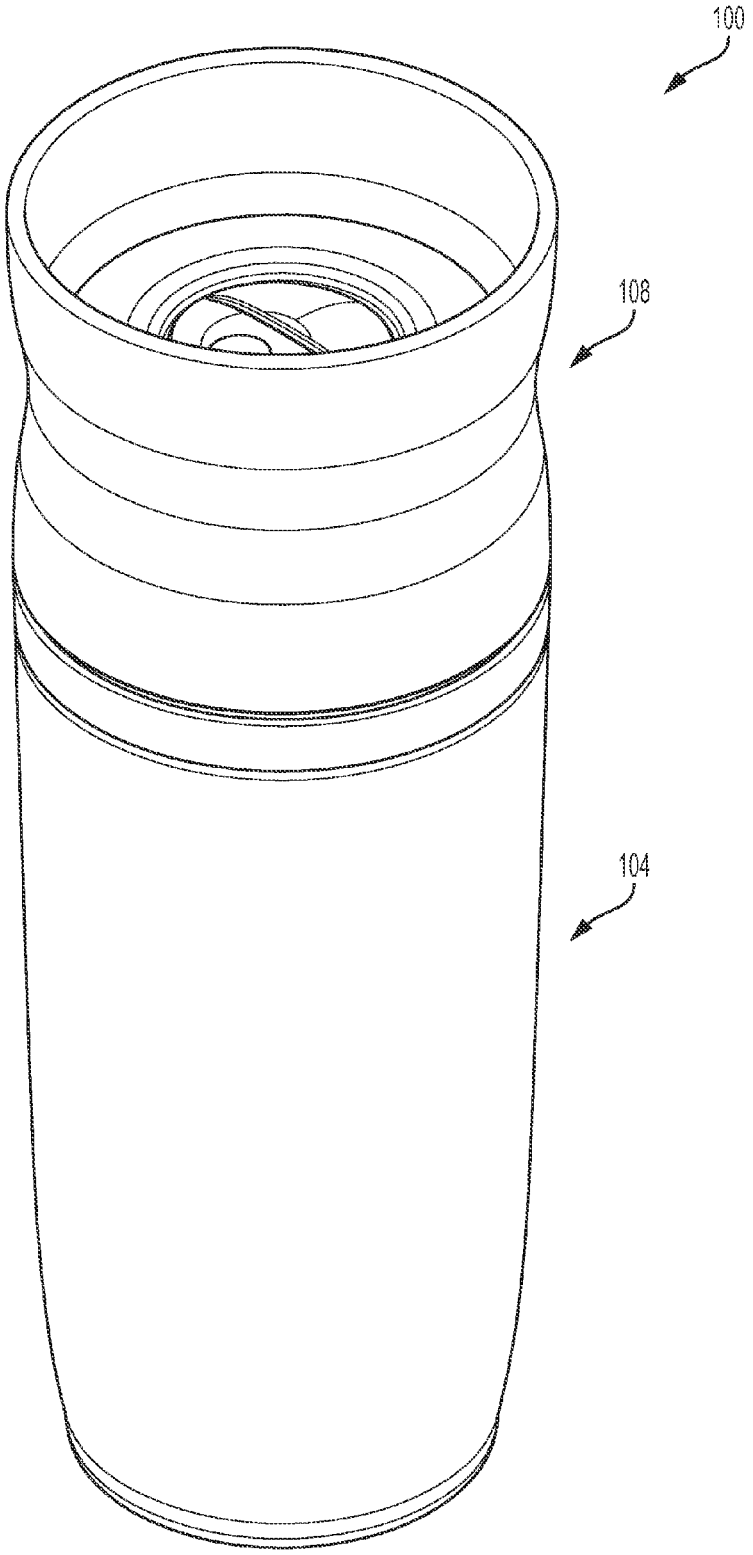
FIG. 1 is a perspective view of a first example of a portable beverage container constructed in accordance with the principles of the present disclosure.
Figure 2:
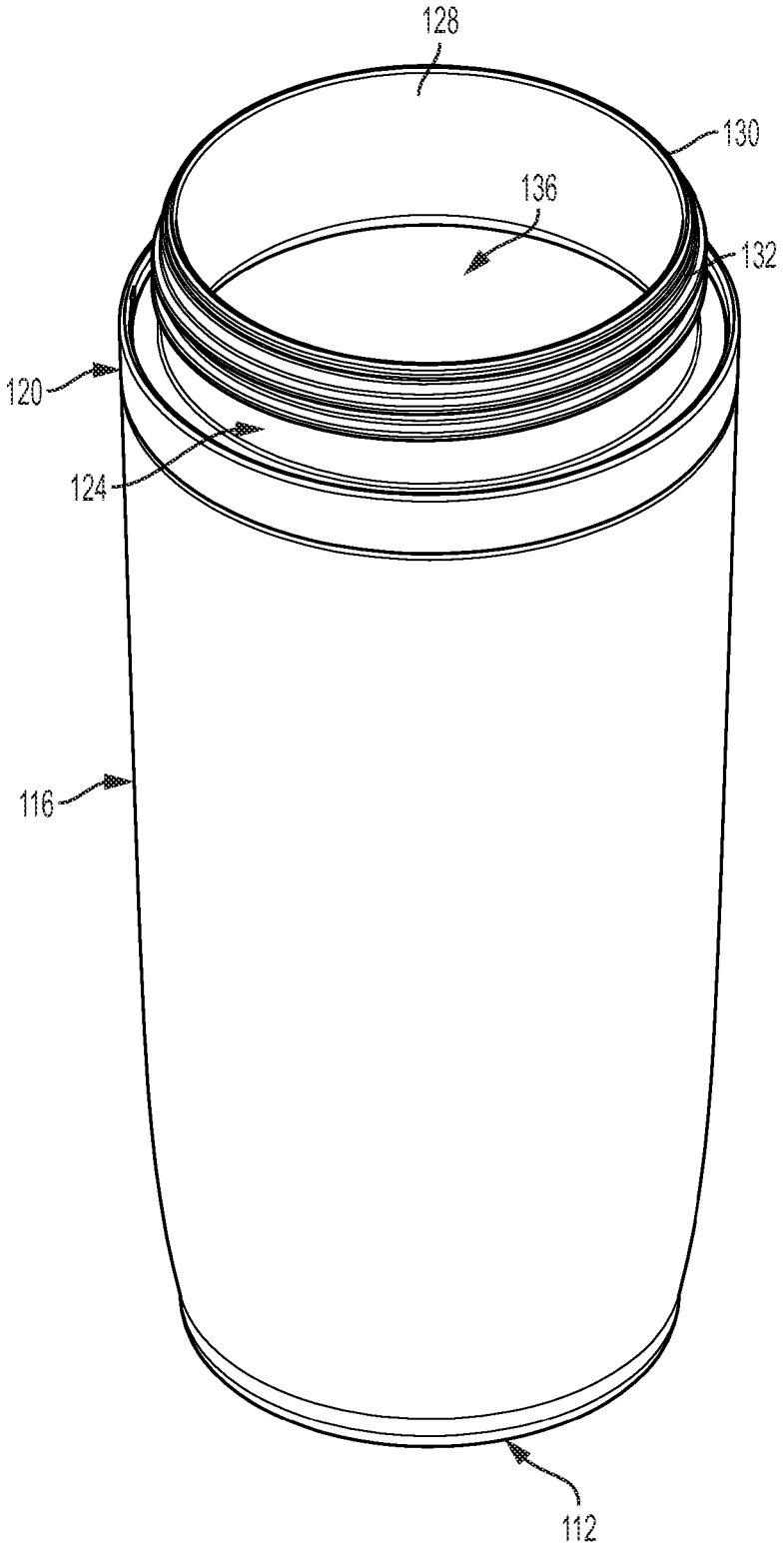
FIG. 2 is a perspective view of a base of the portable beverage container of FIG. 1.

As illustrated in FIG. 2, which depicts the container base 104 with the lid assembly 108 removed therefrom, the container base 104 is defined by a bottom wall 112 and a continuous sidewall 116 that extends upwardly from the bottom wall 112. The sidewall 116 terminates at an upper end 120. The container base 104 further includes a shelf 124 that extends radially inwardly from the end 120 and a collar 128 that extends outwardly (upwardly in FIG. 2) from the shelf 124 for matingly engaging the lid assembly 108. The collar 128 terminates at an upper, open end 130 and has a threaded portion 132 that is configured to mate with a corresponding threaded portion of the lid assembly 108. The bottom wall 112, the sidewall 116, and the collar 128 together define a volume or reservoir 136 for holding or storing the liquid.

Figure 3:
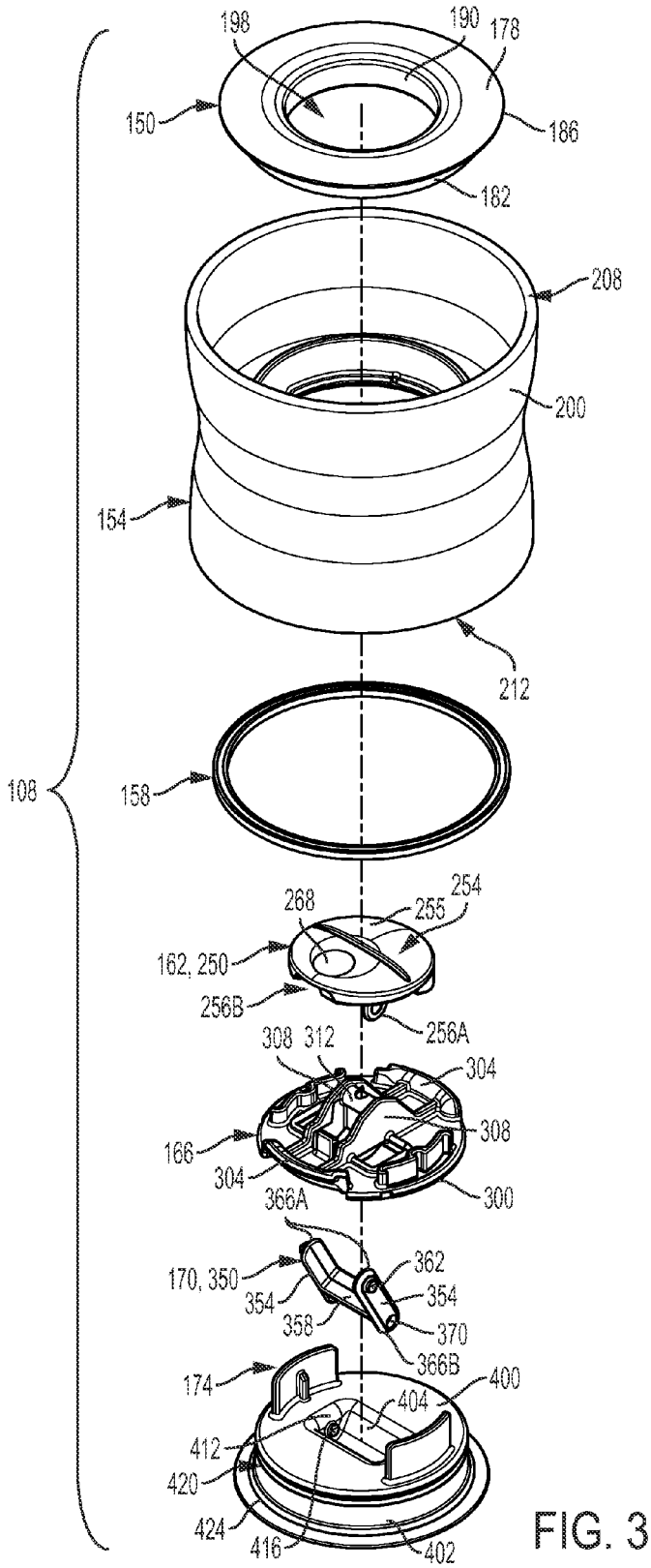
FIG. 3 is an exploded, perspective view of a lid assembly of the portable beverage container of FIG. 1.
Figure 4:
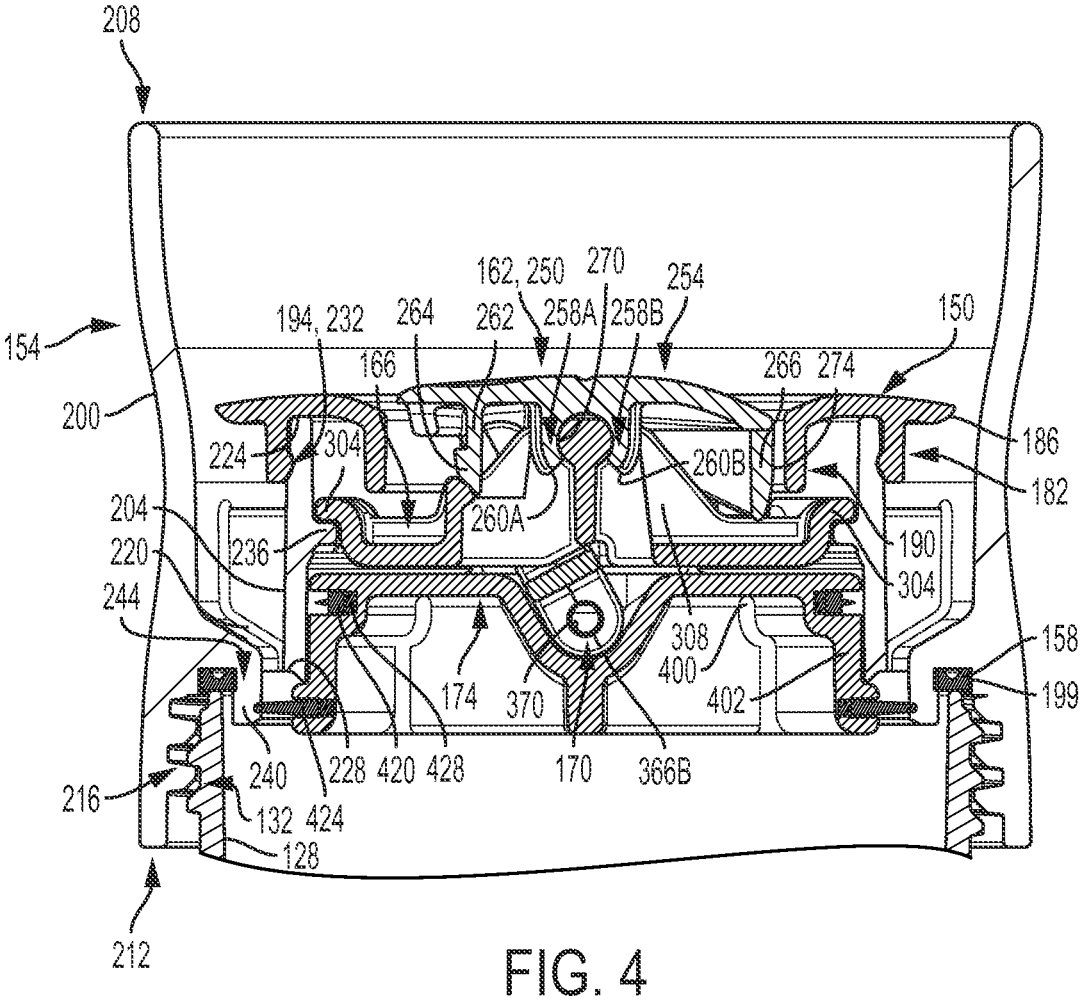
FIG. 4 is a cross-sectional view of the lid assembly of FIG. 3, in a closed position.
Figure 5:
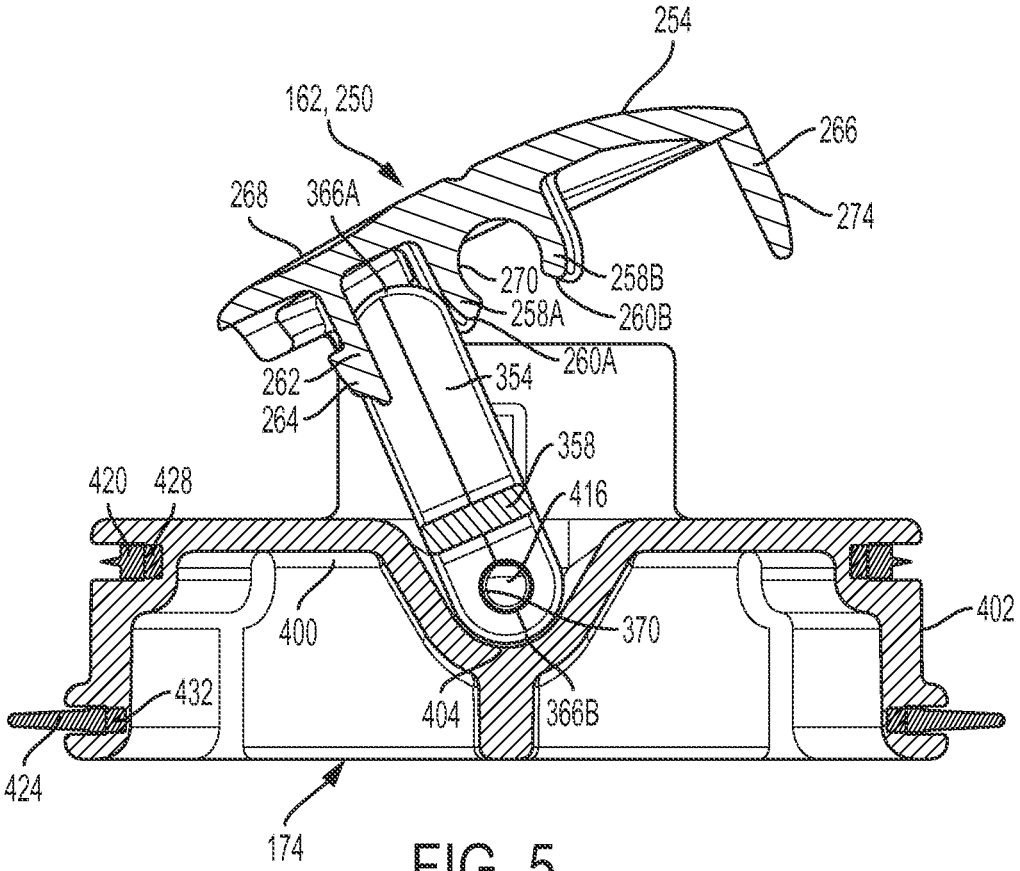
FIG. 5 is a cross-sectional view of the lid assembly of FIG. 3, in an open position, but with some components of the lid assembly removed for ease of illustration.

With reference to FIGS. 3-5, the various components of the lid assembly 108 will now be described. As illustrated in FIGS. 3-5, the lid assembly 108 generally includes a cap 150, a lid housing or body 154, a sealing element 158, an actuation element 162, a plate 166, a linkage element 170, and a valve 174. When the beverage container 100 is assembled, each of the cap 150, the sealing element 158, the actuation element 162, the plate 166, the linkage element 170, and the valve 174 is disposed within the housing 154.

As illustrated in FIGS. 3 and 4, the lid housing 154 includes a substantially cylindrical outer, perimeter wall 200 and a substantially cylindrical inner wall 204. The perimeter wall 200 has a first, or top, open end 208 and a second, or bottom, open end 212 opposite the first end 208. While not illustrated herein, it will be appreciated that the first end 208 will come into contact with a mouth of the user when the user drinks the liquid from the container 100. The second end 212 has a threaded portion 216 sized and arranged to matingly engage the threaded portion 132 of the collar 128 of the container base 104 (as shown in FIG. 4), such that the lid assembly 108 can be removably coupled (e.g., secured) to the container base 104. The inner wall 204 is spaced radially inwardly of the outer wall 200, with a liquid passageway 220 that is defined or formed therebetween, and ultimately allows liquid to be consumed and/or poured from the container 100 by the user. The inner wall 204 has a first, or top, end 224 and a second, or bottom, end 228 opposite the first end 224. The top and bottom ends 224, 228 of the inner wall 204 are positioned axially inwardly of the top and bottom ends 208, 212 of the outer wall 200, such that the height of the inner wall 204 is less than the height of the outer wall 200. The inner wall 204 has a detent 232 formed proximate to the first end 224 and a shelf 236 that extends radially inwardly between the first and second ends 224, 228. The lid housing 154 also defines a valve seat 240. The valve seat 240 in this example is defined by a rib 244 that extends inwardly and downwardly from a portion of the perimeter wall 200 proximate to the bottom end 212 of the wall 200, as illustrated in FIG. 4. In other examples, the valve seat 240 can be defined by a different component of the lid housing 154 (e.g., by the inner wall 204).

As also illustrated in FIGS. 3 and 4, the cap 150 is defined by a substantially annular base 178, a first, or outer, annular wall 182 that extends downwardly from the base 178 proximate to a circumferential edge 186 of the base 178, and a second, or inner, annular wall 190 that extends downwardly from the base 178 at a position radially inward of the first wall 182. The first wall 182 includes a portion 194 that extends radially inwardly and snaps into the detent 232 of the inner wall 204 of the lid housing 154, such that the cap 150 is snapped to the housing 154, as illustrated in FIG. 4. The cap 150 also includes a central opening 198 defined by the second wall 190.

In other examples, the cap 150 can be coupled (e.g., secured) to the housing 154 in a different manner. As an example, the detent 232 of the inner wall 204 can be replaced with a threaded portion, and the portion 194 of the first wall 182 can be threaded, such that the portion 194 matingly engages the corresponding threaded portion of the inner wall 204 to couple the cap 150 to the housing 154.

The sealing element 158 illustrated in FIGS. 3 and 4 takes the form of an annular gasket disposed in a circumferential recess 199 formed in the housing 154 between the rib 244 and a portion of the perimeter wall 200 proximate to the bottom end 212 of the wall 200. So disposed, the sealing element 158 effects a seal between the collar 128 of the container base 104 and the perimeter wall 200 of the lid assembly 108, thereby preventing fluid from leaking out of the container 100 at the joint between the container base 104 and the lid assembly 108.

As illustrated in FIGS. 3-5, the actuation element 162 in this example takes the form of a button 250 disposed within the central opening 198 of the cap 150. The button 250 has a thin, substantially circular base 254, a pair of tabs 256A, 256B (shown in FIG. 3), a pair of prongs 258A, 258B, a leg 262, and a tapered portion 266. The circular base 254 includes a dimpled portion 268 formed or defined on one portion of a top side 255 thereof. The tabs 256A, 256B extend downwardly from an underside of the base 254 and each include a circular aperture (not shown) sized to receive a portion of the linkage element 170. The pair of prongs 258A, 258B extend downwardly from the underside of the body 254, and have ends 260A, 260B, respectively, that curve slightly inwardly toward one another. The body 254 and the prongs 258A, 258B together define a semi-cylindrical channel 270 that receives a portion of the plate 166, as will be described below. The leg 262 also extends downwardly from the underside of the base 254, but at a position radially outward of the prong 258A. A catch surface 264 is formed on, and extends radially outwardly from, a bottom portion of the leg 262. The tapered portion 266 extends downwardly from the base 254 opposite the leg 262 and along or adjacent to a portion of the circumference of the circular base 254. The tapered portion 266 includes or provides a visual indicator 274 (e.g., a color, a logo, text, etc.) that is arranged to be visually indicative of whether the lid assembly 108 is open or closed. In this example, the visual indicator 274, when exposed (i.e., visible to the user of the container 100), indicates that the lid assembly 108 is open.

The plate 166, which is illustrated in FIGS. 3 and 4, has a circumferential edge 300 defined, in part, by a pair of outwardly extending, and slightly curved, projections 304. The projections 304 are arranged opposite one another, as illustrated in FIG. 3. The plate 166 also includes a pair of upstanding, curved walls 308 that are parallel to one another. The projections 304 engage (e.g., rest on) the shelf 236 of the housing 154, such that the plate 166 is coupled to, and securely retained by, the inner wall 204 of the housing 154, as illustrated in FIG. 4. A cylindrical rod 312 is connected to, and extends between, the walls 308. The cylindrical rod 312 is seated within the channel 270 of the actuation element 162, as illustrated in FIG. 4, such that the actuation element 162 is pivotably coupled to the plate 166.

As illustrated in FIGS. 3-5, the linkage element 170 in this example takes the form of a linkage 350 having a substantially H-shaped profile. The linkage 350 has a pair of parallel bars 354 and a bar 358 extending between and connecting the bars 354 to one another. A protuberance 362 is formed or defined on, and extends outwardly from, an end 366A of each of the bars 354, while an aperture 370 is formed or defined at and through an end 366B of each of the bars 354. The protuberances 362 are disposed in the circular apertures formed or defined in the tabs 256A, 256B of the button 250, as illustrated in FIGS. 4 and 5, such that the linkage element 170 is coupled (e.g., secured) to the actuation element 162. The apertures 370, meanwhile, receive a portion of the valve 174, as will be described in greater detail below.

The valve 174 illustrated in FIGS. 3-5 is movably disposed within the housing 154 and has a substantially disc-shaped body 400 having a circumferential wall 402. A recessed area 404 is formed or defined in a central portion of a top side of the body 400. The area 404 receives a bottom portion (e.g., the ends 366B) of the linkage element 170. As best illustrated in FIG. 3, each of a pair of surfaces 412 that partially define the recessed area 404 includes an inwardly extending protuberance 416 (only one is visible in FIG. 3). The protuberances 416, which extend only partially into the recessed area 404, are inserted into the apertures 370 of the linkage element 170 (see FIG. 5), as illustrated in FIGS. 4 and 5, such that the bottom portion of the linkage element 170 is coupled (e.g., secured) to the valve 174.

The valve 174 also includes a pair of sealing elements, an upper sealing element 420 and a lower sealing element 424. The upper sealing element 420, which can, for example, be a gasket, is disposed in a recess 428 formed in an upper portion of the circumferential wall 402, such that the upper sealing element 420 is arranged to sealingly engage the inner wall 204 of the housing 154. The lower sealing element 424, which can, for example, be a gasket, is disposed in a recess 432 formed in a lower portion of the circumferential wall 402, such that the lower sealing element 424 is arranged to sealingly engage the valve seat 240 when the lid assembly 108 is in the closed position, but is movable relative to the valve seat 240 to open the liquid passageway 220. As illustrated in FIG. 5, the lower sealing element 424 protrudes further radially outward than the upper sealing element 420, though this need not be the case.

With the linkage element 170 connected to each of the actuation element 162 and the valve 174, the linkage element 170 connects the actuation element 162 with the valve 174. In other words, the actuation element 162 is operatively coupled to the valve 174 via the linkage element 170. Thus, movement of the actuation element 162 by, for example, a user of the container 100 causes the valve 174 to move within the housing 154, thereby opening or closing the lid assembly 108, and thus the container 100, as desired.

When the lid assembly 108 is in the closed position, illustrated in FIG. 4, the lid assembly 108 substantially prevents any liquid contained in the container base 104 from passing through the liquid passageway 220 and exiting the container 100. In the closed position, the actuation element 162 is in the substantially horizontal position illustrated in FIG. 4, such that the valve 174, and more particularly the lower sealing element 424, sealingly engages the valve seat 240 (defined by the rib 244). As illustrated in FIG. 4, the sealing engagement between the lower sealing element 424 and the valve seat 240 seals off the liquid passageway 220, preventing any liquid from flowing upward from the container base 104 to the lid assembly 108 and out of the container 100. Moreover, when the actuation element 162 is in this closed position, the tapered portion 266 is positioned below a top surface of the base 178 of the cap 150, such that the visual indicator 274 is hidden from view, thereby visually indicating to the user (or some other user) that the lid assembly 108 is in the closed position.

Figure 6:
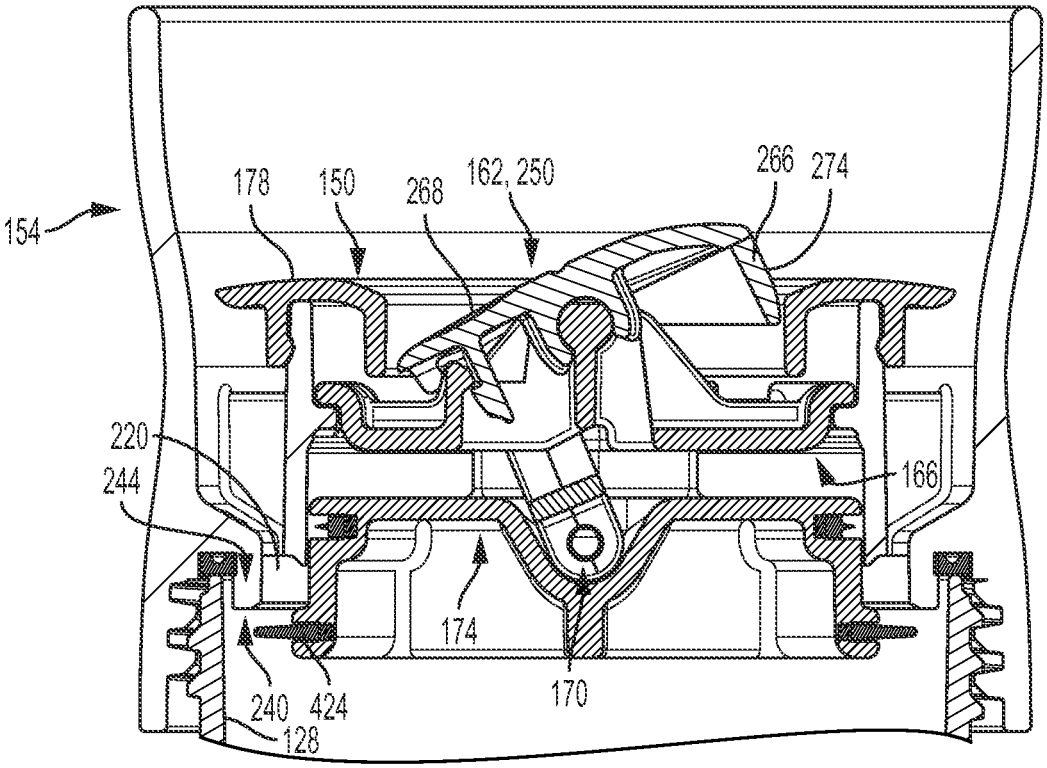
FIG. 6 is a cross-sectional view of the lid assembly of FIG. 3, in an open position.

When, however, the user of the container 100 wants to open the container (e.g., the user wants to drink from the container 100), the user can quickly and easily reconfigure the lid assembly 108 from the closed position illustrated in FIG. 4 to the open position illustrated in each of FIGS. 5 and 6. This is accomplished by applying a force to the dimpled portion 268 of the actuation element 162, which in turn causes the actuation element 162 to pivot in a first direction (for example, counter-clockwise) about the plate 166 such that (i) the catch surface 264 of the actuation element 162 slides downward along and past a similarly structured, but opposing, catch surface extending radially inward from a portion of the plate 166, and (ii) the tapered portion 266 moves upward such that at least a portion of the tapered portion 266 extends above the base 178 of the cap 150, as illustrated in FIG. 6. By virtue of this pivotable movement of the actuation element 162, the linkage element 170 is driven downward, relative to the cap 150 and the plate 166, within the housing 154, and the valve 174, which is connected to the linkage element 170, is driven downward in a similar manner, such that a vertical distance between the plate 166 and the valve 174 is increased relative to the closed position. As a result, the lower sealing element 424 of the valve 174 is driven out of sealing engagement with and away from the valve seat 240, thereby opening the liquid passageway 220, as illustrated in FIG. 6. This movement opens the lid assembly 108, and thus the container 100. In turn, liquid contained in the container base 104 can be poured out of the container base 104 and through the liquid passageway 220 for consumption by the user of the container 100 at or along any portion of the circumference of the top end 208 of the perimeter wall 200 of the lid assembly 108. Moreover, because at least a portion of the tapered portion 266 is positioned vertically above a top surface of the cap base 178, at least a portion of the visual indicator 274 is exposed, i.e., visible to the user (or some other user), thereby providing visual feedback to the user (or some other user) that the lid assembly 108 is in the open position.

Of course, the user can, when desired (e.g., when the user has consumed a desired amount of liquid from the container 100), quickly and easily return the lid assembly 108 to the closed position illustrated in FIG. 4. This is accomplished by applying a force on a portion of the actuation element 162 opposite the dimpled portion 268 (e.g., in FIG. 6, the right hand portion of the actuation element 162), which in turn causes the actuation element 162 to pivot in a second direction opposite to the first direction (for example, clockwise) about the plate 166 such that (i) the catch 264 of the actuation element 162 slides upward along and past the similarly structured, but opposing, catch extending radially inward from a portion of the plate 166, and (ii) the tapered portion 266 moves downward, below the top surface of the base 178 of the cap 150, such that the visual indicator 274 is hidden from view, thereby providing visual feedback to the user (or some other user) that the lid assembly 108 is in the closed position. By virtue of this pivotable movement of the actuation element 162, the linkage element 170 is driven upward, relative to the cap 150 and the plate 166, within the housing 154, and the valve 174, which is connected to the linkage element 170, is driven upward in a similar manner, such that a vertical distance between the plate 166 and the valve 174 is decreased relative to the open position. As a result, the lower sealing element 424 of the valve 174 is driven (back) into sealing engagement with the valve seat 240, thereby sealing off the liquid passageway 220, as illustrated in FIG. 4. In the illustrated embodiment, the plate 166 and the valve 174 are adjacent to and/or in contact with one another in the closed position.

It will be appreciated that the components of the portable beverage container 100 can be made of or manufactured from one or more different materials, such as, for example, one or more polymers (e.g., Tritan copolyester, silicone, polypropylene, Acetal, TPE), and one or more metals (e.g., Stainless Steel). In one example, the container base 104 is made of or manufactured from Tritan copolyester, the cap 150, the housing 154, the plate 166, the linkage element 170, and the valve 174 are each made of or manufactured from polypropylene, and the sealing elements 158, 420, and 424 are made of or manufactured from silicone or thermoplastic elastomers. In other examples, Stainless Steel or Acetal can be used instead of polypropylene. In yet other examples, various surfaces of the portable beverage container 100 can be overmolded. As an example, the visual indicator 274 may be molded over the tapered portion 266. As another example, the container base 104 and/or the lid housing 154 can be over molded with a soft material (e.g., TPE) to provide the container 100 with a "soft-touch" feel.

It will also be appreciated that the portable beverage container 100 can vary from the container 100 illustrated in FIGS. 1-6 and yet still perform the intended functionality.

Figure 7:
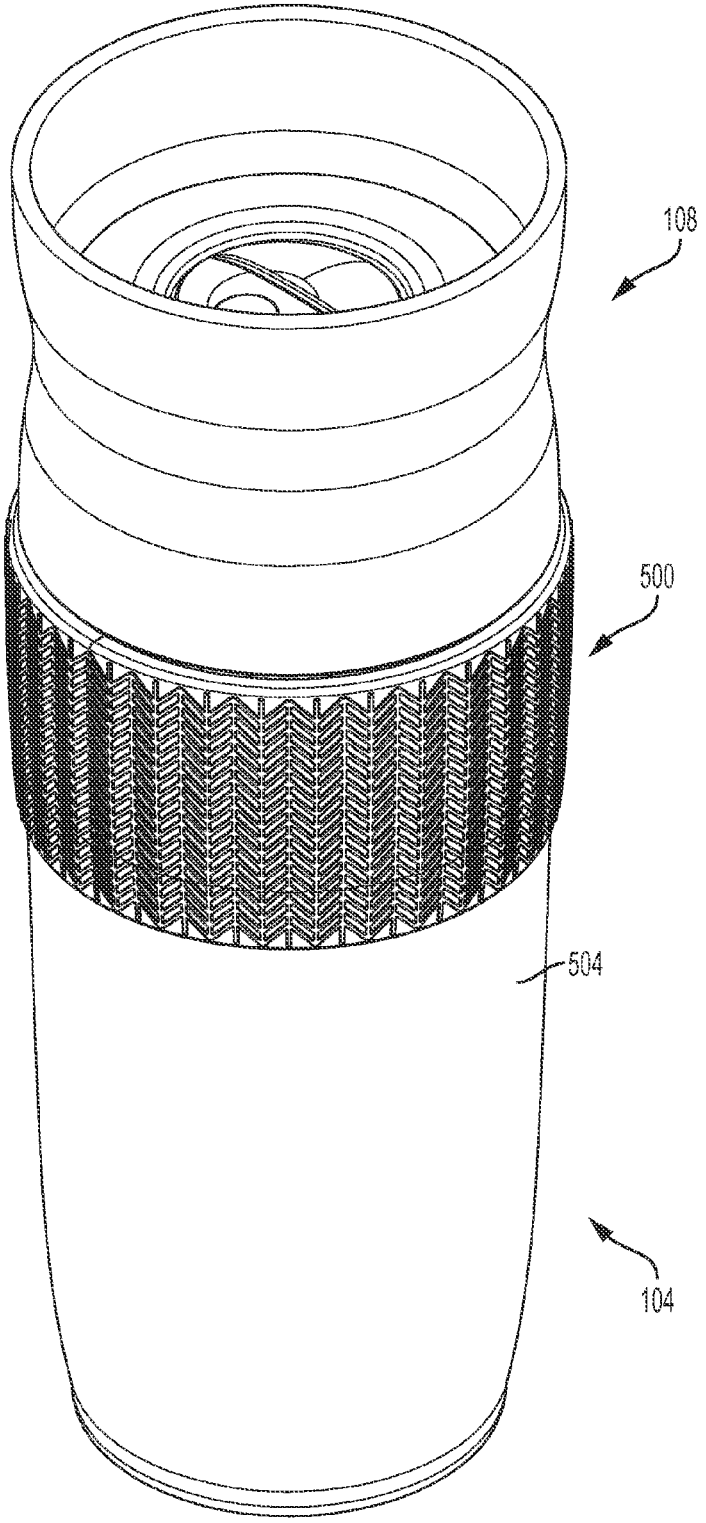
FIG. 7 is a perspective view of a second example of a portable beverage container constructed in accordance with the principles of the present disclosure.
Figure 8:
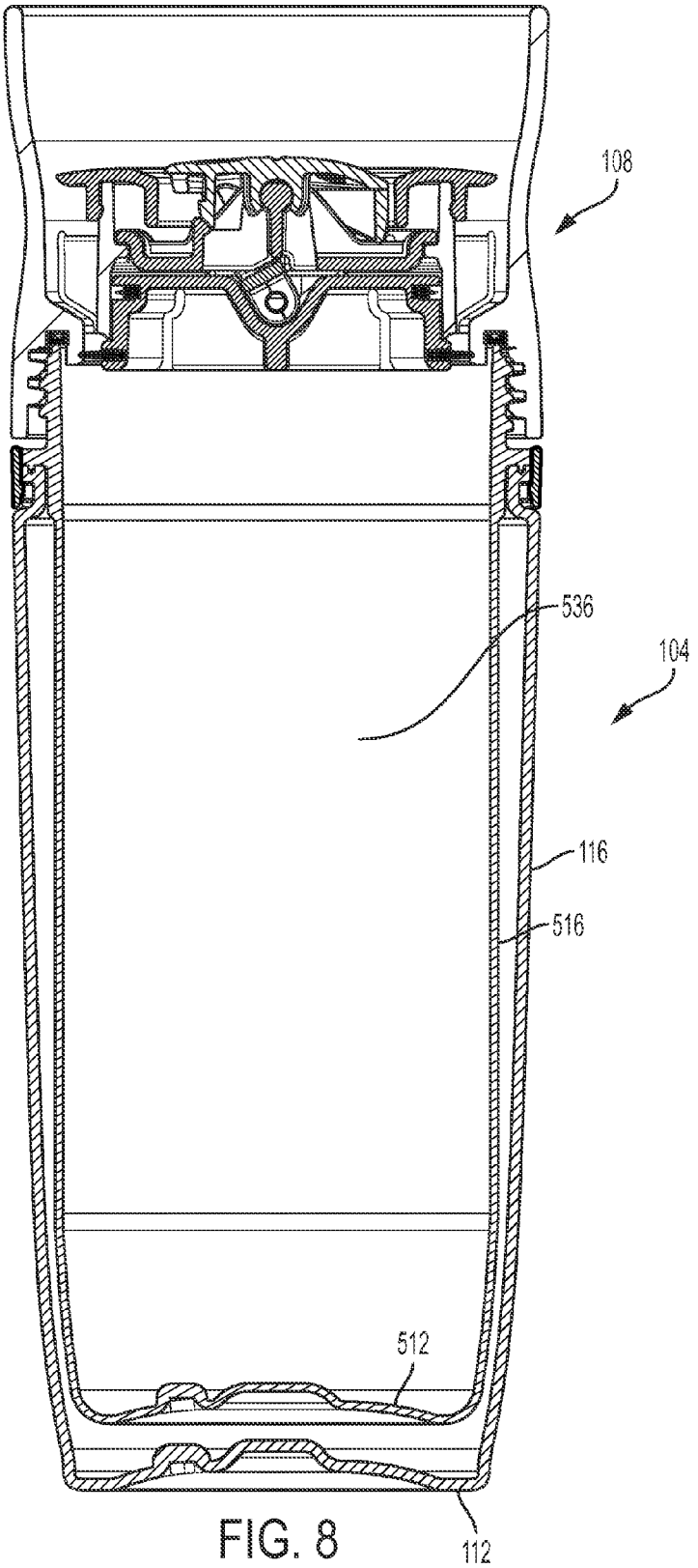
FIG. 8 is a cross-sectional view of a third example of a portable beverage container constructed in accordance with the principles of the present disclosure.
Figure 9:
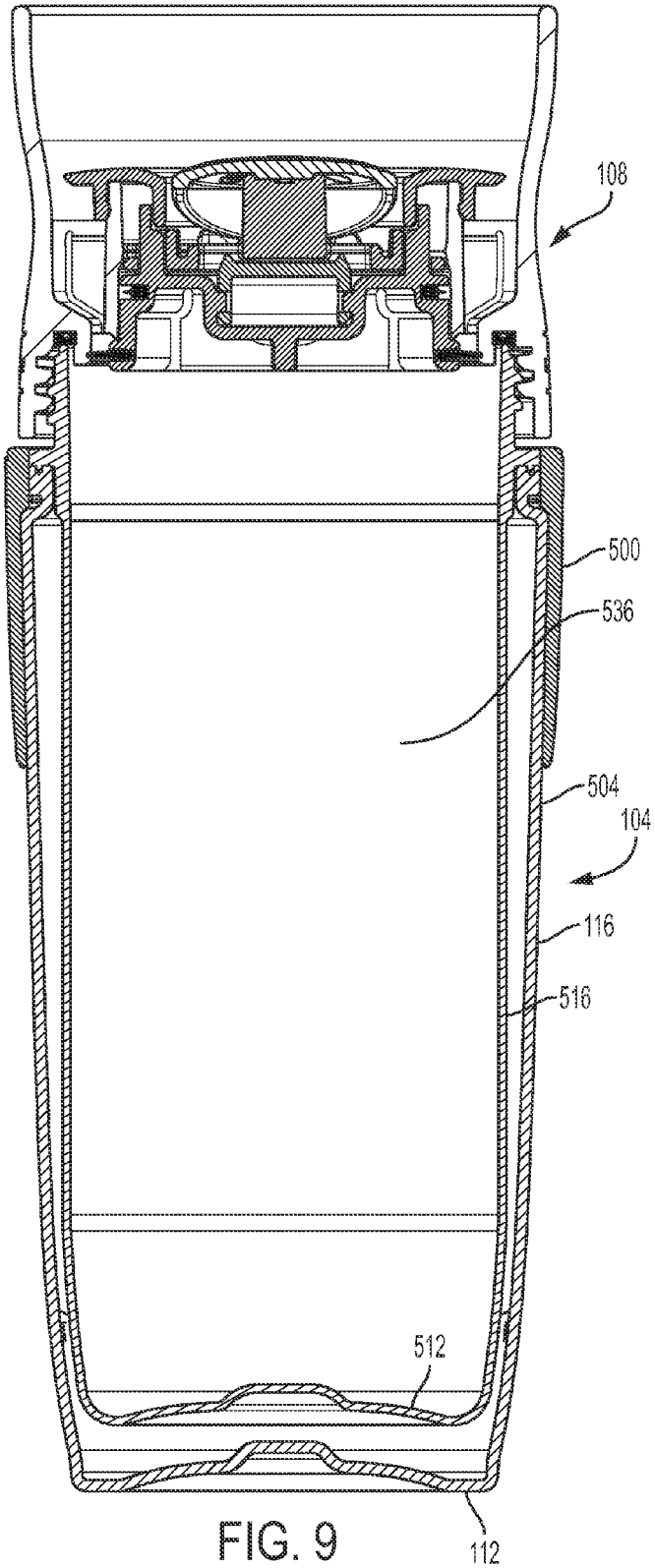
FIG. 9 is a cross-sectional view of a fourth example of a portable beverage container constructed in accordance with the principles of the present disclosure.

In some cases, the container base 104 can vary from the illustrated embodiment. As illustrated in FIG. 7, a grip 500 can be formed or disposed on an exterior portion 504 of the sidewall 116 of the container base 104, thereby allowing the user of the container 100 to easily and securely pick-up and carry the container 100. The grip 500 in this example is made of TPE and is positioned immediately adjacent the lid assembly 108, though the grip 500 can be made of or from a different material and/or positioned elsewhere. As illustrated in FIG. 8, the container base 104 can have a double-walled construction, rather than a single-walled construction, with the bottom 112 and the sidewall 116 defining the exterior of the container base 104, and an interior bottom wall 512 and an interior sidewall 516 defining the volume or reservoir 536 for holding or storing the liquid. As illustrated in FIG. 9, the container base 104 can include the grip 500 and have a double-walled construction.

Figure 10:
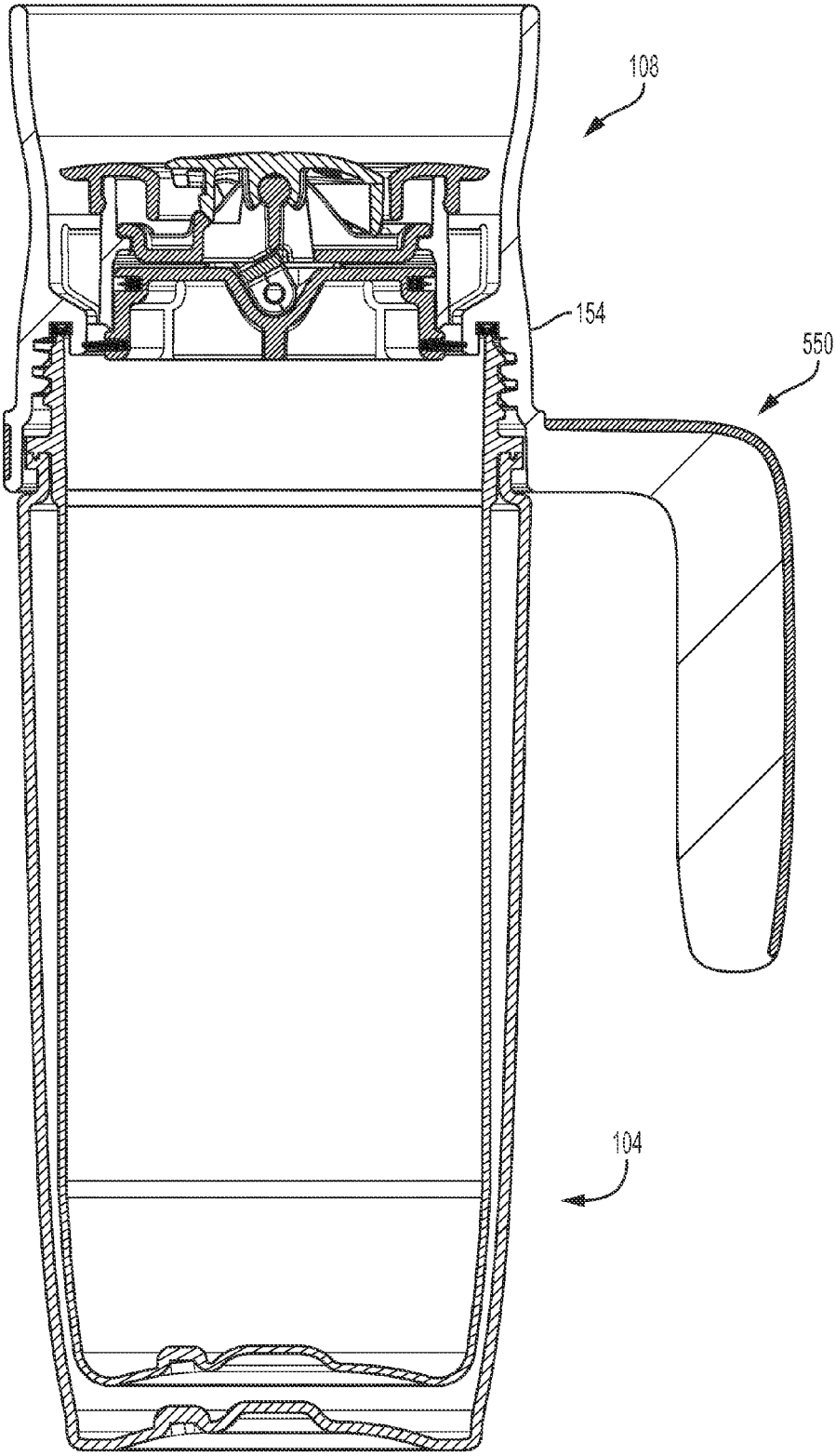
FIG. 10 is a cross-sectional view of a fifth example of a portable beverage container constructed in accordance with the principles of the present disclosure.

Alternatively or additionally, the lid assembly 108, and the components thereof, can vary from the illustrated embodiment. More specifically, for example, the cap 150, the housing 154, the actuation element 162, the plate 166, the linkage element 170, and/or the valve 174 can vary in shape, size, and/or construction, and/or can be arranged differently relative to one another, provided that the actuation element 162 pivots and opens the fluid passageway 220. In one example, the actuation element 162 can pivot in a clockwise direction, rather than a counter-clockwise direction, to open the lid assembly 108, and, in turn, open the liquid passageway 220. It will be appreciated that in such an example, the actuation element 162 can pivot in a counter-clockwise direction, rather than a clockwise direction, to close the lid assembly 108, and, in turn, seal the liquid passageway 220. As illustrated in FIG. 10, for example, the housing 154 can include an outwardly extending handle 550 that allows the user of the container 100 to pick up and carry the container 100. As another example, instead of relying on the user of the container 100 to manually return the lid assembly 108 to its closed position, the lid assembly 108 can include one or more biasing elements which operate to return the lid assembly 108 to its closed position.

While not illustrated herein, it will also be appreciated that the lid assembly 108 can be used in connection with a pitcher, a mug, a tumbler, or any other container base. Several alternative examples have been described and illustrated herein. A person of ordinary skill in the art would appreciate the features of the individual embodiments, and the possible combinations and variations of the components. A person of ordinary skill in the art would further appreciate that any of the examples could be provided in any combination with the other examples disclosed herein. While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. Consequently, it will be understood by those skilled in the art that many of those details may be varied without departing from the spirit and scope of the invention and that only such limitations as appear in the appended claims should be placed on the invention.

The invention claimed is:

1. A portable beverage container, comprising:

a container base adapted to store a liquid; and a lid assembly removably coupled to the base, the lid assembly comprising:

a housing defined by a perimeter wall and an inner wall spaced radially inwardly of the perimeter wall, the housing defining a valve seat and a liquid passageway defined between the perimeter wall and the inner wall, the liquid passageway defined radially outward of the inner wall;

a valve movably disposed within the housing, the valve movable between an open position, wherein the valve is spaced from the valve seat and the liquid can flow through the liquid passageway and out of the container base, and a closed position, wherein the valve sealingly engages the valve seat and the liquid is prevented from flowing through the liquid passageway;

an actuation element pivotably coupled to a portion of the lid assembly; and a linkage element coupled to the valve, the actuation element operatively coupled to the valve via the linkage element to move the valve between the open position and the closed position.

2. The portable beverage container of claim 1, wherein the lid assembly further comprises a plate coupled to the housing, the actuation element being pivotably coupled to the plate.

3. The portable beverage container of claim 1, wherein the inner wall comprises an inwardly extending shelf, and wherein the lid assembly further comprises a plate seated on the inwardly extending shelf, the actuation element being pivotably coupled to the plate.

4. The portable beverage container of claim 1, wherein the valve comprises a first sealing element arranged to sealingly engage the inner wall of the housing and a second sealing element arranged to sealingly engage the valve seat when the valve is in the closed position.

5. The portable beverage container of claim 1, wherein the lid assembly does not include a biasing element for biasing the valve and/or the actuation element to the closed position.

6. The portable beverage container of claim 1, wherein the actuation element comprises a visible indicator indicative of whether the valve is open, the visible indicator being visible when the valve is open, and the visible indicator being concealed from view when the valve is closed.

7. The portable beverage container of claim 1, wherein the lid assembly further comprises a recessed area formed in a top portion of the valve, the linkage element having a first end seated in the recessed area.

8. The portable beverage container of claim 7, wherein the valve further comprises at least one protuberance that extends at least partially into the recessed area, the first end of the linkage element being coupled to the valve via the at least one protuberance.

9. The portable beverage container of claim 7, wherein the linkage element has a second end, opposite the first end, seated between two downwardly extending portions of the actuation element.

10. The portable beverage container of claim 1, wherein the liquid passageway circumscribes the actuation element.

11. The portable beverage container of claim 1, wherein the housing further defines a central longitudinal axis, and wherein the liquid passageway is circumferentially arranged around the central longitudinal axis.

12. A lid assembly for use with a beverage container base adapted to store a liquid, the lid assembly comprising:

a housing defined by an outer wall and an inner wall spaced radially inwardly of the outer wall, the housing defining a valve seat and a liquid passageway defined between the outer wall and the inner wall, the liquid passageway defined radially outward of the inner wall;

a valve movably disposed within the housing, the valve movable between an open position, wherein the valve is spaced from the valve seat such that the liquid can flow through the liquid passageway, and a closed position, wherein the valve sealingly engages the valve seat such that the liquid is prevented from flowing through the liquid passageway;

an actuation element pivotably coupled to a portion of the lid assembly; and a linkage element coupled to the valve, the actuation element operatively coupled to the valve via the linkage element to move the valve between the open position and the closed position.

13. The lid assembly of claim 12, further comprising a plate coupled to the housing, the actuation element being pivotably coupled to the plate.

14. The lid assembly of claim 12, wherein the inner wall comprises an inwardly extending shelf, and wherein the lid assembly further comprises a plate seated on the inwardly extending shelf, the actuation element being pivotably coupled to the plate.

15. The lid assembly of claim 12, wherein the valve comprises a first sealing element arranged to sealingly engage the inner wall of the housing and a second sealing element arranged to sealingly engage the valve seat when the valve is in the closed position.

16. The lid assembly of claim 12, wherein the lid assembly does not include a biasing element for biasing the valve and/or the actuation element to the closed position.

17. The lid assembly of claim 12, wherein the actuation element comprises a visible indicator indicative of whether the valve is open, the visible indicator being visible when the valve is open, and the visible indicator being concealed from view when the valve is closed.

18. The lid assembly of claim 12, wherein the valve further comprises at least one protuberance that extends at least partially into the recessed area, the first end of the linkage element being coupled to the valve via the at least one protuberance.

19. The lid assembly of claim 12, wherein the linkage element has a second end, opposite the first end, seated between two downwardly extending portions of the actuation element.

20. A lid assembly for use with a beverage container base adapted to store a liquid, the lid assembly comprising:

a housing defining a valve seat and a liquid passageway;

a valve movably disposed within the housing, the valve movable between an open position, wherein the valve is spaced from the valve seat such that the liquid can flow through the liquid passageway, and a closed position, wherein the valve sealingly engages the valve seat such that the liquid is prevented from flowing through the liquid passageway;

an actuation element pivotably coupled to a portion of the lid assembly; and a linkage element coupled to the valve, the actuation element operatively coupled to the valve via the linkage element to move the valve between the open position and the closed position, wherein the lid assembly further comprises a recessed area formed in a top portion of the valve, the linkage element having a first end seated in the recessed area.

* * * * *